US007404737B1

(12) United States Patent
Youtsey

(10) Patent No.: US 7,404,737 B1
(45) Date of Patent: Jul. 29, 2008

(54) COAXIAL CABLE CONNECTOR

(75) Inventor: Timothy L. Youtsey, Scottsdale, AZ (US)

(73) Assignee: Phoenix Communications Technologies International, Gilbert, AZ (US)

( * ) Notice: Subject to any disclaimer, the term of this patent is extended or adjusted under 35 U.S.C. 154(b) by 0 days.

(21) Appl. No.: 11/806,252

(22) Filed: May 30, 2007

(51) Int. Cl.
*H01R 9/05* (2006.01)

(52) U.S. Cl. ..... 439/578

(58) Field of Classification Search ..... 439/578–585, 439/63, 805, 811, 394, 784, 675
See application file for complete search history.

(56) References Cited

U.S. PATENT DOCUMENTS 5,011,432 A * 4/1991 Sucht et al. ..... 439/584
5,281,167 A * 1/1994 Le et al. ..... 439/578
5,284,449 A * 2/1994 Vaccaro ..... 439/583

* cited by examiner

*Primary Examiner*—Edwin A. León
(74) *Attorney, Agent, or Firm*—Troxell Law Office, PLLC

(57) ABSTRACT

A coaxial cable connector includes a standard and a mini adapter. The standard adapter includes coaxial hollow inner and outer sleeves. The mini adapter includes an inner member having a finger clamp; and a cylindrical housing having a first and a second tubular end portion. The first tubular end portion is externally formed of elastic hooking portions corresponding to the finger clamp in the mini adapter, and a plurality of long slots behind the elastic hooking portion. A contact spring is provided in the mini adapter with contact strips thereof received in the long slots. When the mini adapter is fully inserted into the standard adapter, the inner sleeve compresses the elastic hooking portions to thereby force the finger clamp to engage with a central conductor of the coaxial cable, and pushes the contact strips to mechanically and electrically engage with a foil layer of the coaxial cable.

9 Claims, 9 Drawing Sheets

COAXIAL CABLE CONNECTOR

FIELD OF THE INVENTION

The present invention relates to a connector for connecting an end of a coaxial cable to a mating connector, and more particularly to a coaxial cable connector that may be used with coaxial cables of different specifications.

BACKGROUND OF THE INVENTION

An existing coaxial connector is used to connecting a coaxial cable to a mating connector, so that the coaxial cable may be used in cable TV signal transmission, data transmission line, etc. The coaxial cable normally includes a central conductor, an insulator surrounding the central conductor, a foil layer surrounding the insulator, at least one braided conducting sheath surrounding the foil layer, and a jacket surrounding the at least one braided conducting sheath. The currently available coaxial cables may be divided into several different specifications, including RG6, RG7, RG11, RG59, etc., and each coaxial cable of a specific specification must be installed with a corresponding connector. When a coaxial cable is connected to a mismatching connector, failures in signal transmission would occur. Moreover, a large number of connectors in different specifications must be manufactured at increased cost to match differently sized coaxial cables.

It is uneasy to determine whether a cable and a connector have the same specification. Most cable installers determine the correct matching of cable and connector simply based on personal working experiences. Before a coaxial connector can be installed onto an end of a coaxial cable, that end of the coaxial cable must be processed for associating with the connector. Then, the connector is manually pushed onto the processed cable end until the jacket and the braided conducting sheath of the coaxial cable are isolated from the insulator and the coaxial cable has been inserted into the connector by a required depth. Finally, a hexagonal clamping tool is used to compress the connector against the coaxial cable to firmly join them together. In response to the coaxial cables of different specifications, total three differently sized hexagonal clamping tools must be prepared to ensure the application of sufficient compression force on the coaxial connector. The differently sized hexagonal clamping tools require extra cost and are inconvenient for carrying. It is therefore desirable to develop a coaxial cable connector that may be used with coaxial cables of different specifications.

SUMMARY OF THE INVENTION

A primary object of the present invention is to provide a coaxial cable connector that may be used with coaxial cables of different specifications.

Another object of the present invention is to provide a coaxial cable connector that may be firmly and stably clamped to coaxial cables of different specifications.

To achieve the above and other objects, the coaxial cable connector according to the present invention includes a standard adapter and a mini adapter. The standard adapter includes an inner sleeve, an outer sleeve coaxially mounted around the inner sleeve, and a fastener mounted to a front end of the standard adapter for connecting to a receiver or a terminal, so that the coaxial cable is mechanically and electrically connected to the receiver or the terminal via the coaxial cable connector.

The mini adapter includes an inner member having a finger clamp for holding and thereby electrically connecting to a central conductor of the coaxial cable; a cylindrical housing having a first tubular end portion for receiving the inner member therein, and a second tubular end portion externally having a plurality of elastic hooking portions located corresponding to the finger clamp and a plurality of long slots coaxially located behind the elastic hooking portions; a contact spring mounted in the first tubular end portion; a conducting element located outside and around the contact spring; and a round sleeve externally mounted around the second tubular end portion.

When the coaxial cable is connected to the mini adapter, and the mini adapter is pushed into the standard adapter, the elastic hooking portions on the mini adapter are radially compressed by the inner sleeve of the standard adapter to thereby force the finger clamp to mechanically and electrically contact with the central conductor of the coaxial cable, and contact strips on the contact spring are also pushed by the inner sleeve to mechanically and electrically contact with a foil layer of the coaxial cable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
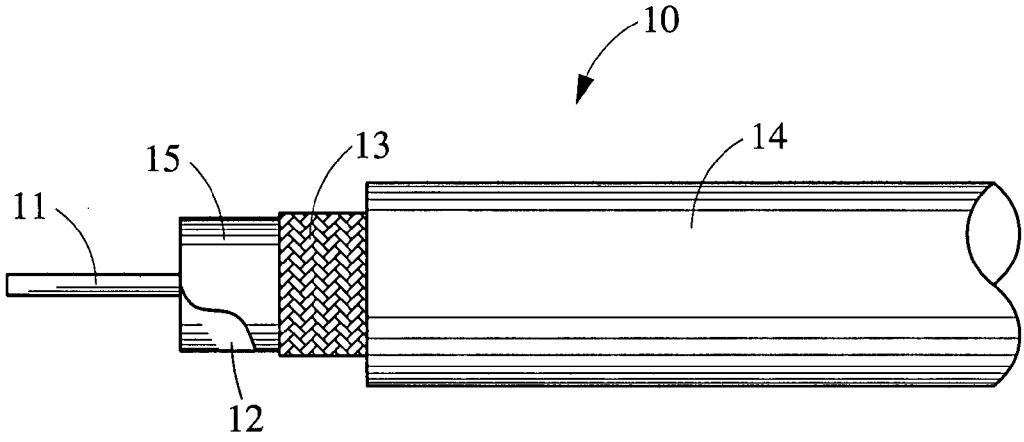
FIG.1A PRIOR ART
FIG. 1*a* is a plan view showing a coaxial cable with a processed end for connecting to a coaxial cable connector.
Figure 1B:
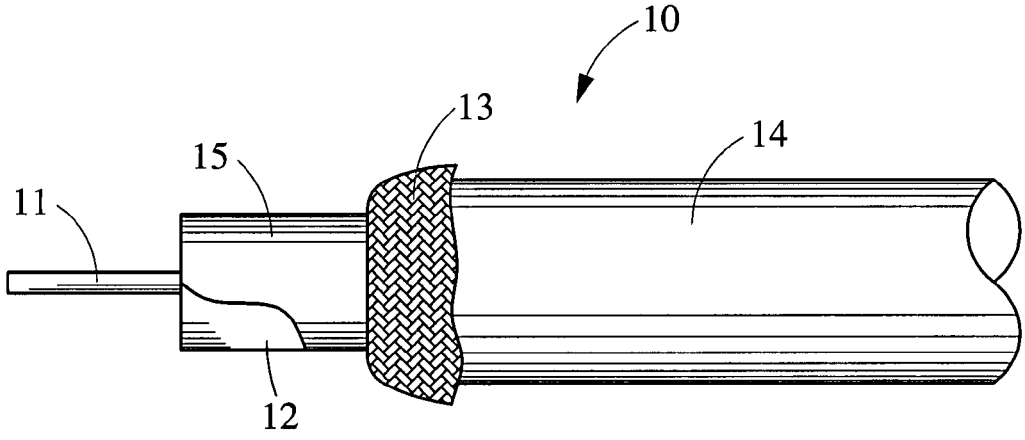
FIG.1B PRIOR ART
FIG. 1*b* is a plan view showing a braided conducting sheath at the processed end of the coaxial cable of FIG. 1*a* is turned back to cover part of a jacket of the coaxial cable.

Please refer to FIG. 1*a* that is a plan view showing a coaxial cable 10 with a processed end. It is known an end of a coaxial cable for connecting to a coaxial cable connector must be processed before the coaxial cable can be connected at that end to the coaxial cable connector. To process the end of the coaxial cable 10 for connecting to a coaxial cable connector, a cable installer may use a cutting tool (not shown) to strip off part of a jacket 14 at that end of the coaxial cable 10 to expose part of a central conductor 11, a foil layer 15, and a braided conductor sheath 13 of the coaxial cable 10. The foil layer 15 is provided to surround a dielectric insulator 12. A length for the stripped part of the coaxial cable 10 is determined according to the standards of related industrial codes. Then, the exposed braided conductor sheath 13 is turned back to cover part of the jacket 14 of the coaxial cable 10, as shown in FIG. 1*b*.

Figure 2:
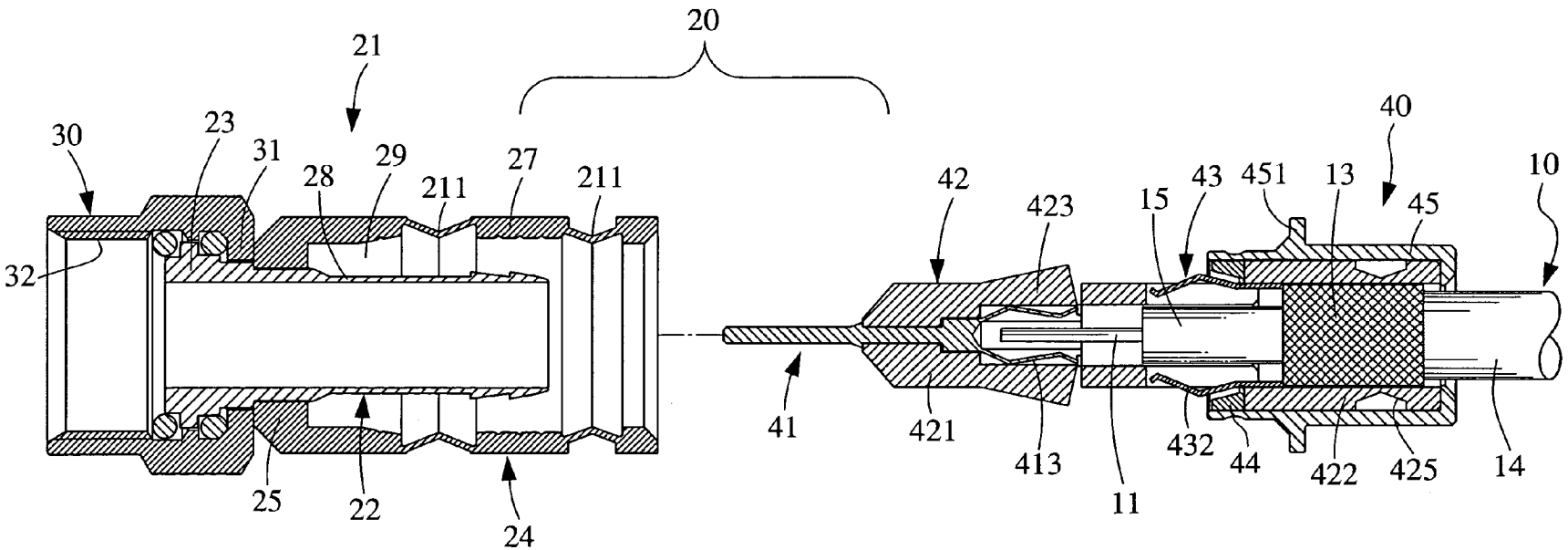
FIG. 2 is an exploded sectional view of a coaxial cable connector of the present invention having a mini adapter connected to a coaxial cable and a standard adapter for receiving the mini adapter therein.

Please refer to FIG. 2 that is an exploded sectional view of a coaxial cable connector 20 according to the present invention. As shown, the coaxial cable connector 20 includes a standard adapter 21 and a mini adapter 40. The standard adapter 21 can be used with connector interfaces such as F connector, BNC, RCA, IEC etc. In the present invention, the standard adapter 21 is configured as an F connector simply for the purpose of exemplification. As shown, the standard adapter 21 includes an inner sleeve 22 having a front end provided with a radially outward extended flange 23; and an outer sleeve 24 having a main body 25 mounted around the inner sleeve 22 and a rear extension portion 27 concentric with a rear extension portion 28 of the inner sleeve 22 to define an annular hollow space 29 between the inner and the outer sleeve 22, 24. A fastener 30 is provided at a front end of the standard adapter 21. The fastener 30 has a rear end formed into a radially inward extended flange 31, which is freely rotatably located between the outward flange 23 of the inner sleeve 22 and the main body 25 of the outer sleeve 24. The fastener 30 is internally provided with threads 32, and externally formed into a hexagonal head, at where a wrench or other hand tool may be used to lock the coaxial cable connector 20 to an electronic apparatus, such as a receiver or a terminal, so that the coaxial cable connector 20 is mechanically and electrically connected to the electronic apparatus.

The outer sleeve 24 is formed on the rear extension portion 27 with at least one first annular recess portion 211, which has a wall thickness smaller than that of other areas on the rear extension portion 27. When an axial force is applied to the outer sleeve 24, the at least one first annular recess portion 211 is subjected to an axially inward pressure and becomes bent under stress.

The existing standard adapter 21 is usable with a coaxial cable having a relative large outer diameter, such as an RG6 cable, but not a coaxial cable having a relative small outer diameter, such as an RG59 cable.

For the coaxial cable connector 20 of the present invention to be applicable to more than one cable specification, a cable with a relative small outer diameter may be associated with the standard adapter 21 via the mini adapter 40.

Figure 3:
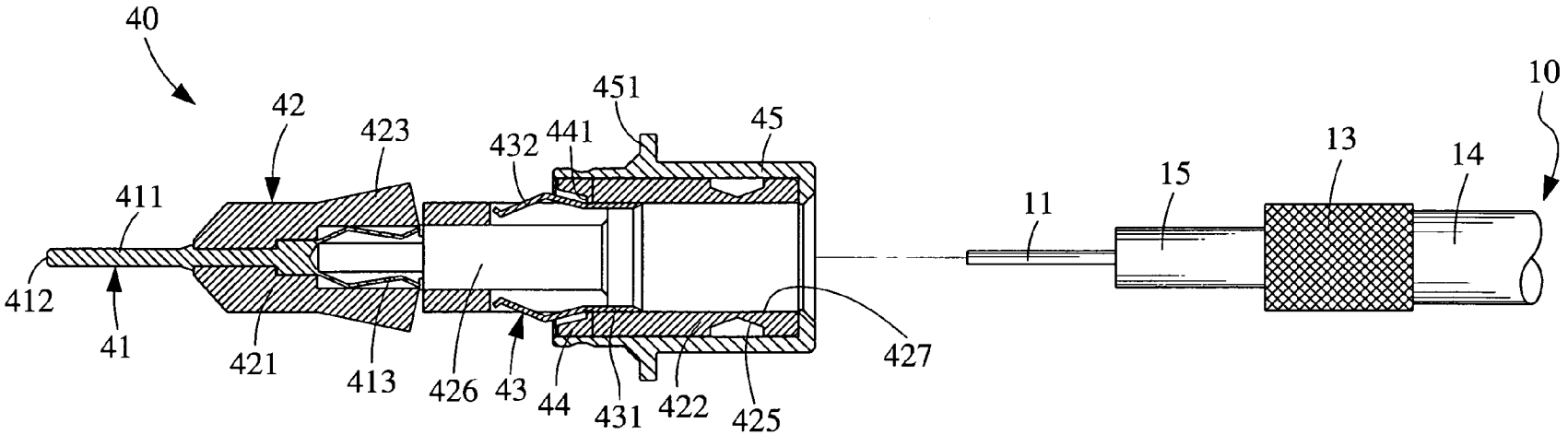
FIG. 3 is an exploded sectional view showing the mini adapter of the present invention is ready for associating with a coaxial cable.
Figure 4:
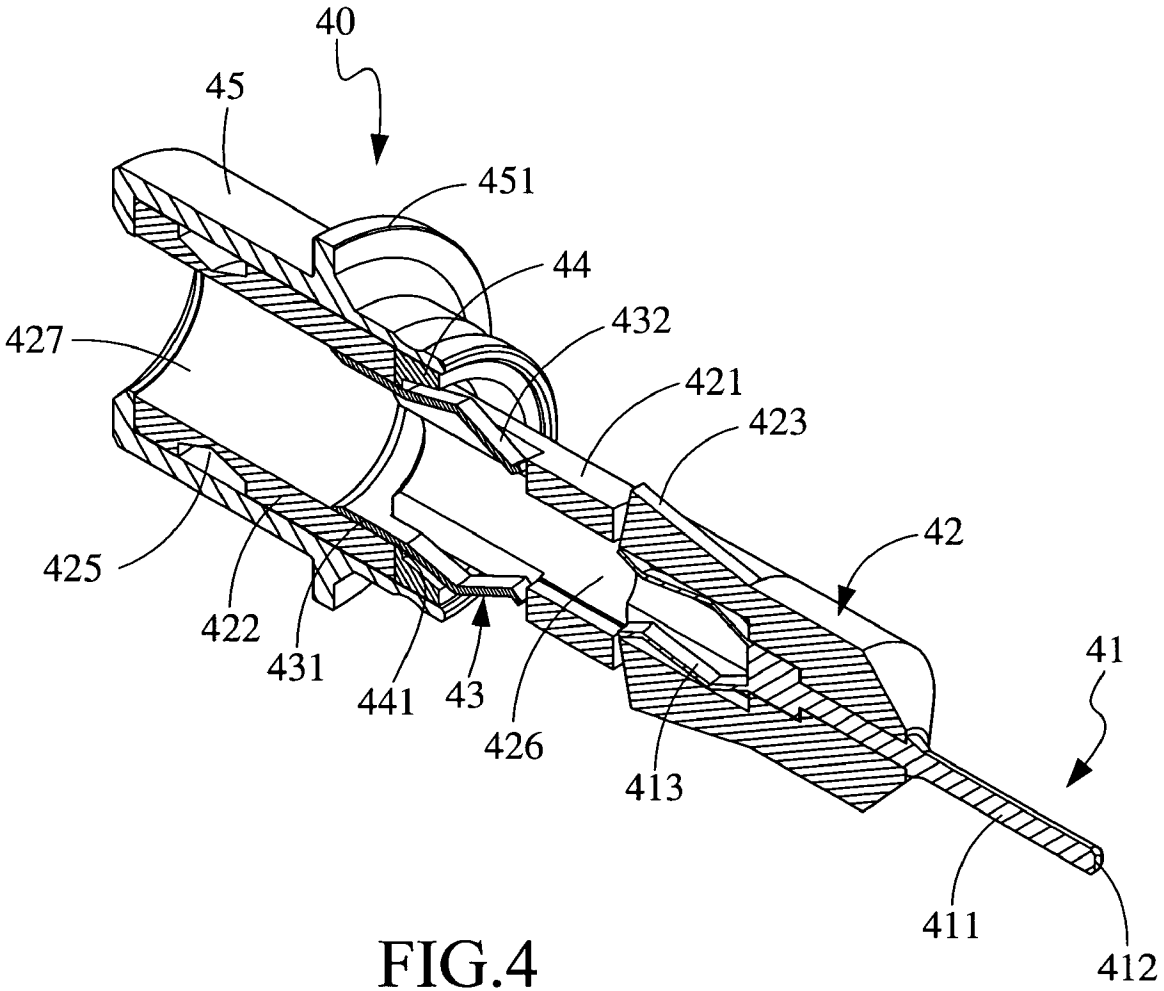
FIG. 4 is a sectioned perspective view of the mini adapter of the present invention.

Please refer to FIGS. 3 and 4. The mini adapter 40 includes an inner member 41, a cylindrical housing 42, a contact spring 43, a conducting element 44, and a round sleeve 45. The inner member 41 is coaxially fitted in the cylindrical housing 42, and includes an elongated body 411, a nose 412 forming a front end of the elongated body 411, and a finger clamp 413 rearward extended from a rear end of the elongated body 411. The finger clamp 413 is so configured that it is able to firmly hold the central conductor 11 of the coaxial cable 10 inserted into the mini adapter 40.

Figure 5B:
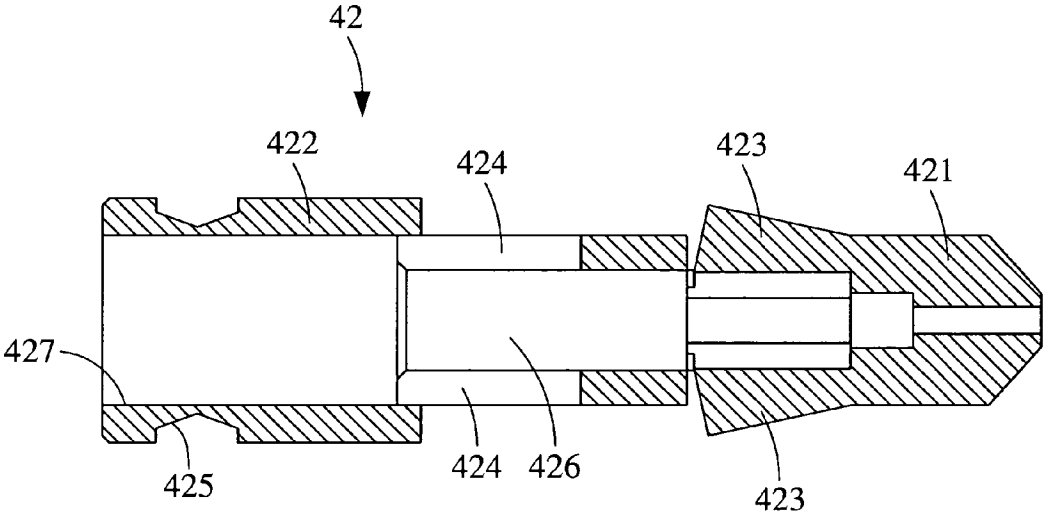
FIG. 5A and FIG. 5B are perspective and sectioned side views, respectively, of a cylindrical housing of the mini adapter.
Figure 5A:
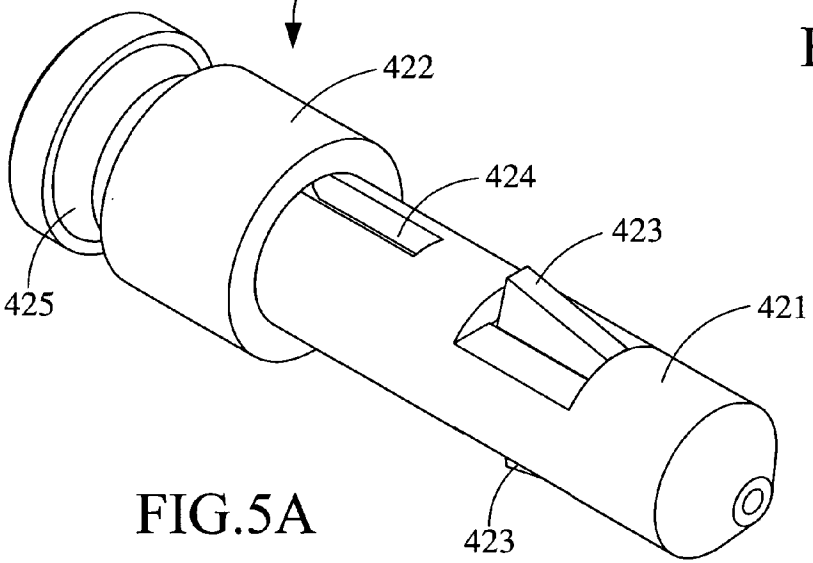

FIGS. 5A and 5B are perspective and sectioned side views, respectively, of the cylindrical housing 42 of the mini adapter 40. The cylindrical housing 42 is made of an insulating material and has a first tubular end portion 421 internally defining a stepped through hole 426, and a second tubular end portion 422 internally defining a through hole 427 communicating with the stepped through hole 426. The first tubular end portion 421 externally includes a plurality of axially extended elastic hooking portions 423 correspondingly located around the finger clamp 413, and a plurality of long slots 424 coaxial with the elastic hooking portions 423. The second tubular end portion 422 is externally formed at a predetermined position with a second annular recess portion 425, which has a wall thickness smaller than that of other areas on the second tubular end portion 422. When an axial force is applied to the cylindrical housing 42, the second annular recess portion 425 is subjected to an axially inward pressure and becomes bent under stress. The bent second annular recess portion 425 would be forced to press against and thereby stably associate with the jacket 14 of the coaxial cable 10 inserted in the mini adapter 40.

Figure 6:
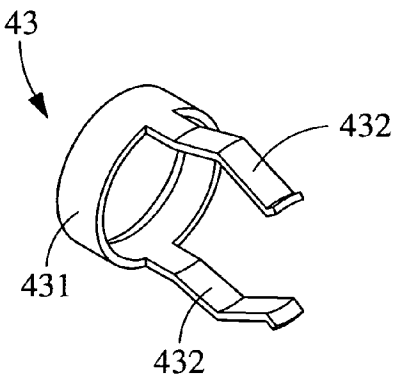
FIG. 6 is a perspective view of a contact spring mounted in the mini adapter.

The contact spring 43 is made of a metal material, and includes a ring portion 431 seated in the through hole 427 of the second tubular end portion 422, and a plurality of contact strips 432 integrally formed with and extended from the ring portion 431. The contact strips 432 are located in the long slots 424 of the first tubular end portion 421. The contact spring 43 illustrated in FIG. 6 has two contact strips 432 equally spaced along the ring portion 431. The contact spring 43 is configured to clamp the foil layer 15 of the coaxial cable 10 with the contact strips 432.

The conducting element 44 is made of a metal material, and has a radially inward extended flange 441 in contact with the ring portion 431 of the contact spring 43, as can be seen from FIGS. 3 and 4.

The round sleeve 45 is coaxially mounted to outer side of the second tubular end portion 422 and the conducting element 44, ensuring that the round sleeve 45, the conducting element 44, and the contact spring 43 are in good metal-to-metal contact. The round sleeve 45 has a radially outward extended flange 451 formed at a predetermined position thereof.

Figure 7A:
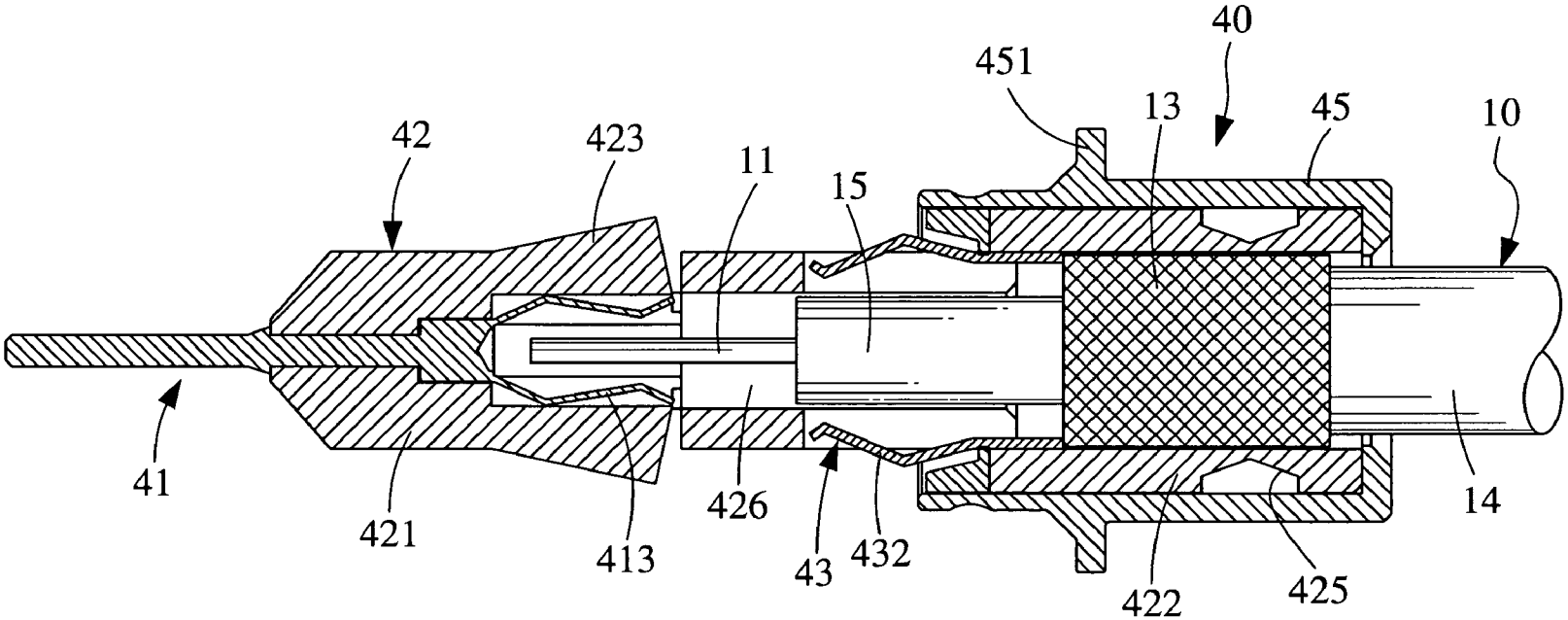
FIGS. 7A, 7B, 7C, and 7D show the procedures of connecting a coaxial cable to the coaxial cable connector of the present invention.

FIGS. 7A through 7D show the procedures of connecting the coaxial cable 10 to the coaxial cable connector 20. In the first procedure as shown in FIG. 7A, the processed end of the coaxial cable 10 is inserted into the mini adapter 40 via a rear end of the cylindrical housing 42.

Figure 7B:
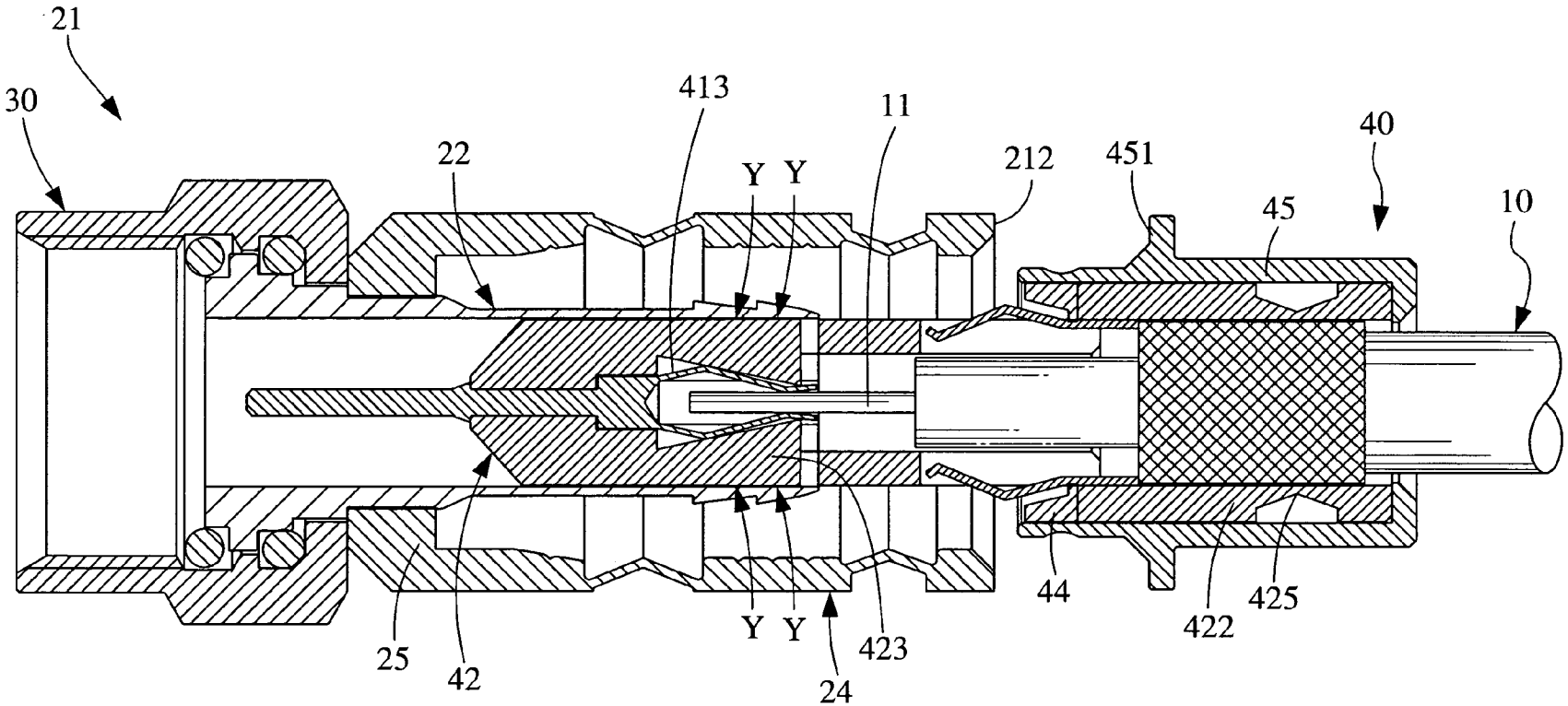

In the second procedure, the mini adapter 40 having the coaxial cable 10 associated therewith is inserted into the standard adapter 21 via rear ends of the outer sleeve 24 and the inner sleeve 22, as shown in FIG. 7B. When the cylindrical housing 42 of the mini adapter 40 has been inserted into the inner sleeve 22, the elastic hooking portions 423 on the cylindrical housing 42 are subjected to a force in a direction indicated by the arrows Y, and radially moved toward a center of the cylindrical housing 42. The radially inward moved elastic hooking portions 423 in turn apply a radial force on the finger clamp 413 at the rear end of the inner member 41, urging the finger clamp 413 to firmly clamp the central conductor 11 of the coaxial cable 10. Therefore, a good mechanical and electrical connection of the central conductor 11 of the coaxial cable 10 to the finger clamp 413 of the inner member 41 of the mini adapter 40 is ensured.

Figure 7C:
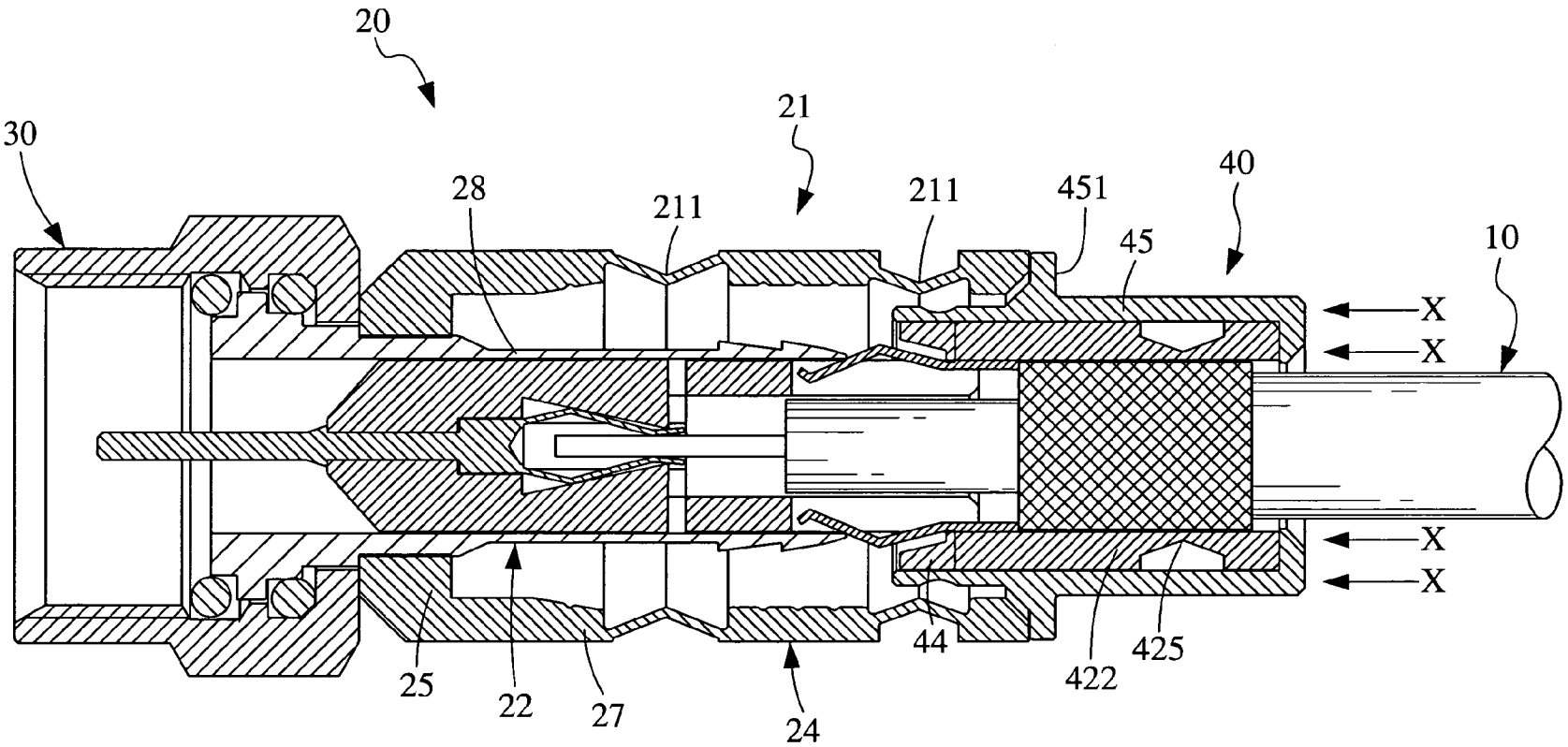
Figure 7D:
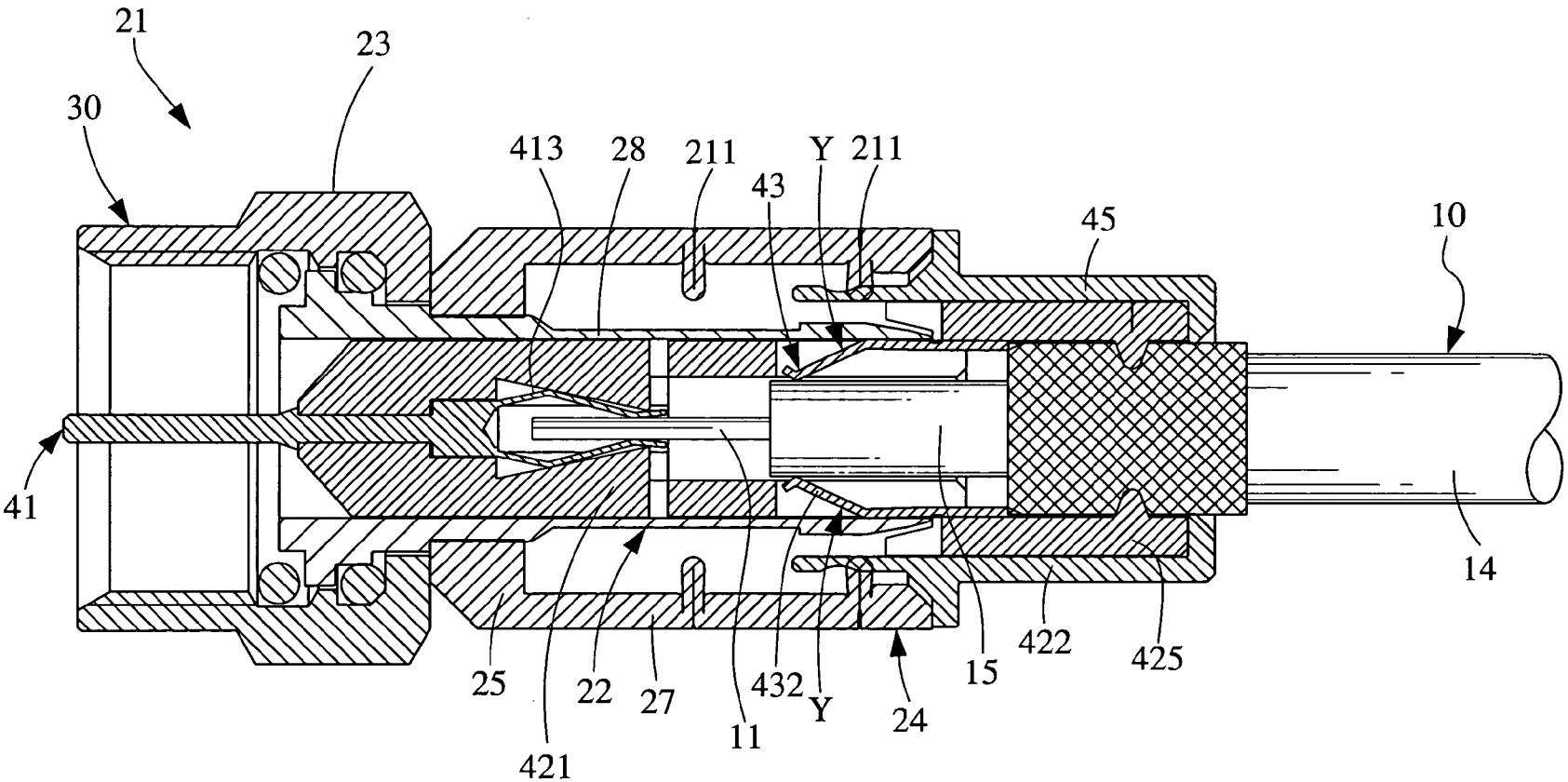

In the third procedure, the mini adapter 40 is pushed further into the standard adapter 21 using a suitable installation tool. At this point, the outward flange 451 of the round sleeve 45 is in contact with a rear end surface 212 of the outer sleeve 24 of the standard adapter 21, as shown in FIG. 7C. To complete the association of the mini adapter 40 with the standard adapter 21, an axial insertion force as indicated by the arrows X is applied to the round sleeve 45. At this point, the at least one first annular recess portion 211 on the outer sleeve 24 of the standard adapter 21 and the second annular recess portion 425 at the second tubular end portion 422 of the cylindrical housing 42 of the mini adapter 40 are also subjected to an axially inward pressure and become bent under stress, as shown in FIG. 7D. At this final association position, the at least one first annular recess portion 211 on the outer sleeve 24 is urged to tightly contact and accordingly, mechanically associate with an outer surface of the round sleeve 45. Meanwhile, the bent second annular recess portion 425 on the second tubular end portion 422 is compressed against the jacket 14 of the coaxial cable 10 to complete a mechanical association of the mini adapter 40 with the jacket 14 of the coaxial cable 10.

When the at least one first annular recess portion 211 and the second annular recess portion 425 are bent, the contact spring 43 is moved forward into the inner sleeve 22, and the contact strips 431 of the contact spring 43 are subjected to radial forces as indicated by the arrows Y to shift toward the center of the cylindrical housing 42 and accordingly mechanically and electrically contact with the foil layer 15 of the coaxial cable 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A coaxial cable connector for mechanically and electrically connecting a coaxial cable to an electronic apparatus, the coaxial cable including a central conductor, an insulator surrounding the central conductor, a foil layer surrounding the insulator, at least one layer of braided conducting sheath surrounding the foil layer, and a jacket surrounding the at least one braided conducting sheath; the coaxial cable connector comprising:

a standard adapter including a hollow inner sleeve and a hollow outer sleeve coaxial with the inner sleeve; and a mini adapter including an inner member mechanically and electrically associated with the central conductor of the coaxial cable; a cylindrical housing having a first tubular end portion adapted to receive the central conductor, the insulator, and the foil layer of the coaxial cable therein, and a second tubular end portion adapted to receive the at least one braided conducting sheath and the jacket of the coaxial cable therein; the first tubular end portion being externally formed with a plurality of elastic hooking portions correspondingly located around the inner member, and internally provided with a contact spring for mechanically associating with the foil layer of the coaxial cable;

whereby when the mini adapter is fully inserted into the standard adapter to associate therewith, the elastic hooking portions are compressed and radially inward moved by the inner sleeve of the standard adapter, urging the inner member of the mini adapter to tightly contact and clamp the central conductor of the coaxial cable, and the contact spring is also compressed by the inner sleeve of the standard adapter to mechanically and electrically contact and associate with the foil layer of the coaxial cable.

2. The coaxial cable connector as claimed in claim 1, wherein the second tubular end portion of the mini adapter is formed on a wall thereof with a second annular recess portion, whereby when an axial insertion force is applied to the round sleeve against the outer sleeve, the second annular recess portion is bent to engage with the jacket of the coaxial cable.

3. The coaxial cable connector as claimed in claim 1, wherein the inner member of the mini adapter includes a finger clamp, which is located in the first tubular end portion corresponding to the elastic hooking portions and adapted to clamp and hold the central conductor of the coaxial cable in place.

4. The coaxial cable connector as claimed in claim 1, wherein the mini adapter further includes a round sleeve externally and coaxially mounted around the second tubular end portion.

5. The coaxial cable connector as claimed in claim 4, wherein the outer sleeve of the standard adapter is formed of at least one first annular recess portion, whereby when an axial insertion force is applied to the round sleeve against the outer sleeve, the at least one first annular recess portion is bent to engage with the round sleeve.

6. The coaxial cable connector as claimed in claim 4, wherein the round sleeve has a radially outward extended flange, which is brought to contact with and push the outer sleeve forward when the round sleeve is subjected to an axial insertion force against the outer sleeve.

7. The coaxial cable connector as claimed in claim 4, further comprising a conducting element located between and electrically connected to the round sleeve and the contact spring.

8. The coaxial cable connector as claimed in claim 1, wherein the first tubular end portion is provided around an area near the second tubular end portion with a plurality of long slots.

9. The coaxial cable connector as claimed in claim 8, wherein the contact spring includes a ring portion configured for fitting in the second tubular end portion, and a plurality of contact strips integrally formed with and extended from the ring portion; and the contact strips being located in the long slots on the first tubular end portion for clamping the foil layer of the coaxial cable.

* * * * *